US011479743B2

(12) United States Patent
Son

(10) Patent No.: US 11,479,743 B2
(45) Date of Patent: Oct. 25, 2022

(54) NATURAL SOAP COMPOSITION HAVING ELASTICITY VISCOELASTICITY AND DUCTILITY WITHOUT CONTAINING POLYVINYL ALCOHOL AND BORAX AND METHOD OF PREPARING THE SAME

(71) Applicant: Ji Min Son, Chuncheon-si (KR)

(72) Inventor: Ji Min Son, Chuncheon-si (KR)

( * ) Notice: Subject to any disclaimer, the term of this patent is extended or adjusted under 35 U.S.C. 154(b) by 78 days.

(21) Appl. No.: 16/640,115

(22) PCT Filed: Feb. 17, 2020

(86) PCT No.: PCT/KR2020/002194
§ 371 (c)(1),
(2) Date: Feb. 19, 2020

(87) PCT Pub. No.: WO2021/167110
PCT Pub. Date: Aug. 26, 2021

(65) Prior Publication Data
US 2022/0002642 A1 Jan. 6, 2022

(51) Int. Cl.
*C11D 9/00* (2006.01)
*C11D 9/40* (2006.01)
(Continued)

(52) U.S. Cl.
CPC ..... *C11D 9/40* (2013.01); *C11D 9/262* (2013.01); *C11D 9/30* (2013.01)

(58) Field of Classification Search
CPC ..... C11D 9/40
See application file for complete search history.

(56) References Cited

U.S. PATENT DOCUMENTS 5,262,079 A * 11/1993 Kacher ..... C11D 10/04 510/146
5,817,609 A * 10/1998 He ..... C11D 3/18 510/133
(Continued)

FOREIGN PATENT DOCUMENTS

JP 2002-512642 A 4/2002
KR 10-2004-0053807 A 6/2004
(Continued)

OTHER PUBLICATIONS

International Search Report dated Nov. 13, 2020 in International Application No. PCT/KR2020/002194.
(Continued)

*Primary Examiner* — Necholus Ogden, Jr.
(74) *Attorney, Agent, or Firm* — Sughrue Mion, PLLC

(57) ABSTRACT

Disclosed are a natural soap composition having elasticity, viscoelasticity and ductility without containing polyvinyl alcohol (PVA) and borax, and a method of preparing the same. The soap composition does not contain a plastic material (PVA), borax, a fungicide, a plasticizer or the like, unlike conventional plastic clay toys, and is thus environmentally friendly and safe, and has a cleaning effect. In addition, the composition has the advantages of better elasticity, viscoelasticity and ductility than general soaps or other elastic soap compositions. In addition, even after the composition is molded into a particular shape, it can be transformed into a variety of shapes, can be used as a toy owing to the maximized tactile stimulation thereof, and provides effects such as psychological stability, stress relief and sensory development.

4 Claims, 2 Drawing Sheets

(51) Int. Cl.
*C11D 9/26* (2006.01)
*C11D 9/30* (2006.01)

(56) References Cited

U.S. PATENT DOCUMENTS

| | | | | |
|---|---|---|---|---|
| 5,935,917 | A * | 8/1999 | Farrell | C11D 17/006 510/141 |
| 6,164,291 | A * | 12/2000 | Filippone | A45D 8/34 132/273 |
| 6,365,140 | B1 * | 4/2002 | Melby | A61K 8/362 424/70.1 |
| 9,962,320 | B2 * | 5/2018 | Kim | A61K 8/42 |
| 2008/0014353 | A1 * | 1/2008 | Stasiak | B82Y 20/00 427/282 |

FOREIGN PATENT DOCUMENTS

| | | | |
|---|---|---|---|
| KR | 10-2009-0010344 | A | 1/2009 |
| KR | 10-1305349 | B1 | 9/2013 |
| KR | 10-1419508 | B1 | 7/2014 |
| KR | 10-2015-0014742 | A | 2/2015 |
| KR | 10-1463241 | B1 | 7/2016 |
| KR | 10-1745855 | B1 | 6/2017 |
| KR | 10-2018-0001253 | A | 1/2018 |
| KR | 10-1812675 | B1 | 1/2018 |
| KR | 10-2068534 | B1 | 2/2020 |
| KR | 10-2136774 | B1 | 7/2020 |

OTHER PUBLICATIONS

Office Action dated Mar. 23, 2020 in Korean Application No. 10-2020-0018848.

* cited by examiner

NATURAL SOAP COMPOSITION HAVING ELASTICITY VISCOELASTICITY AND DUCTILITY WITHOUT CONTAINING POLYVINYL ALCOHOL AND BORAX AND METHOD OF PREPARING THE SAME

TECHNICAL FIELD

The present invention relates to a natural soap composition and a method of preparing the same, and more particularly to a natural soap composition having elasticity, viscoelasticity and ductility without containing polyvinyl alcohol (PVA) and borax, and a method of preparing the same.

BACKGROUND ART

A soap composition having elasticity and viscoelasticity is produced using natural materials to resemble a clay toy made of a plastic material or a mucus toy called a "liquid monster" (slime), which has conventionally been used as a child's toy, and is used as a substitute for the conventional toy.

Liquid monster is a clay toy with elasticity and viscosity and is more commonly referred to as "slime". It has a texture intermediate to those of a liquid and a solid, and has unique properties such as jelly-like resilience and liquid-like mushiness. It has no fixed shape and is viscoelastic, and thus can be molded into a variety of shapes as desired.

"Viscoelasticity" refers to a property of a material that exhibits both viscosity and elasticity. It was originally used as a toy for children, but making slime and displaying the same on YouTube has become popular among adults. The slime stimulates the sense of touch due to the uniqueness of the material thereof, thus providing effects such as psychological stability, stress relief, small muscle development, sensory development and dementia prevention.

The conventional slime mainly uses borax, polyvinyl alcohol (PVA), polyvinyl acetate (PVA) or the like. Borax is a boron compound, which is a lightweight and light-colored or colorless crystalline substance, and is used in detergents, cosmetics or the like, is easily dissolved in water and becomes white when hardened.

Polyvinyl alcohol (PVA) is a kind of water-soluble plastic resin and is mainly used as a starting material for producing films, adhesives, emulsifiers and other resins. Polyvinyl acetate is a synthetic resin obtained by polymerizing vinyl acetate, and is colorless and transparent. It is used for the formation of films of aqueous (latex) paints, or as an adhesive, lacquer, binder or the like, and is also a starting material for polyvinyl alcohol. When polyvinyl alcohol, having a long chain structure, and borax are mixed together, they are ionically bonded, thus producing an elastic material for the slime.

Conventional slime is not entirely safe for the environment or for the health of children. In addition to using the PVA component, which is one of the causes of water pollution, borax prevents the plastic component from being released easily, so that it is broken down like fine plastic pieces and floats in the water rather than dissolved or decomposed. In particular, when a liquid glue is used to produce slime, the small amount of formaldehyde contained in the liquid glue may adversely affect the quality of water, and there is a risk of skin burns due to the thermal energy that is generated during the ionic bonding between PVA and borax.

Apart from the effects of PVA and borax on health, chemical additives such as phthalates may often be used for some products to soften plastics. Phthalates are considered to be hormone-stimulating environmental factors that may affect the kidney, liver and genital diseases and growth disorders in children. In addition, CMIT/MIT, which is used as a preservative, may be more dangerous when inhaled through the respiratory tract of humans and may also affect the environment.

Slime-related patents include Korean Patent No. 10-1745855, Korean Patent Laid-open No. 10-2004-53807, Korean Patent Laid-open No. 10-2009-10344, and Korean Patent Laid-open No. 10-1305349.

DISCLOSURE

Technical Problem

Therefore, the present invention has been made to solve the above problems while realizing the beneficial effects of psychological stability and sensory development of mucous clay toys, and it is one object of the present invention to realize a unique texture without using plastic components and to use a biopolymer and a surfactant for the purpose.

Technical Solution

In accordance with an aspect of the present invention, the above and other objects can be accomplished by the provision of a soap composition including a biopolymer, a soap solution, a starch and an auxiliary agent, wherein the biopolymer includes at least one of: at least one thickener selected from mannan, glucomannan, a *Plantago psyllium* husk powder, gluten, guar gum, agar, alginic acid, locust bean gum, xanthan gum, carrageenan, dextran, diutan gum, glucosamine, gellan gum, gelatin, pectin, whey protein, hydroxyethyl cellulose, carboxymethylcellulose (CMC) and salep; at least one natural resin selected from karaya gum, tragacanth gum, arabic gum, mastic gum, chicle, sorva, jelutong, and natural rubber (*Hevea brasiliensis*); and at least one mucopolysaccharide selected from collagen, chitin, chitosan and hyaluronic acid, and the auxiliary agent includes at least one selected from a surfactant, a concentration regulator, an acidity regulator and a hardener.

In the present invention, the biopolymer is preferably added in an amount of 0.5 to 10% by weight with respect to the total weight of the soap composition.

In accordance with another aspect of the present invention, provided is a method of preparing a soap including: mixing and stirring 10 to 30% by weight of a soap solution, 0.5 to 10% by weight of a biopolymer, 1 to 10% by weight of a nonionic surfactant, 3 to 10% by weight of glycerin, 5 to 15% by weight of a vegetable oil, 10 to 20% of sucrose, 1 to 10% by weight of distilled water and 30 to 50% by weight of starch (a); and cooling the resulting mixture to 0 to 35° C. and aging the same (b) after the step (a), wherein the biopolymer includes at least one of: at least one thickener selected from mannan, glucomannan, a *Plantago psyllium* husk powder, gluten, guar gum, agar, alginic acid, locust bean gum, xanthan gum, carrageenan, dextran, diutan gum, glucosamine, gellan gum, gelatin, pectin, whey protein, hydroxyethyl cellulose, carboxymethylcellulose (CMC), and salep; at least one natural resin selected from karaya gum, tragacanth gum, arabic gum, mastic gum, chicle, sorva, jelutong, and natural rubber (*Hevea brasiliensis*); and at least one mucopolysaccharide selected from collagen, chitin, chitosan and hyaluronic acid.

In the method of preparing a soap according to the present invention, the soap solution may be, for example, a fatty acid soda (soap solution) prepared by dissolving fatty acid or vegetable oil and saponifying the same with sodium hydroxide, potassium hydroxide or emulsified water, or may be prepared by melting the saponified solid soap by heating.

Advantageous Effects

The composition according to the present invention does not contain a plastic material (PVA), borax, a fungicide, a plasticizer or the like, unlike conventional plastic clay toys, thus being environmentally friendly and safe, and having a cleaning effect. In addition, the composition of the present invention has the advantages of better elasticity, viscoelasticity and ductility than general soaps or other elastic soap compositions. In addition, even after the composition is molded into a particular shape, it can be transformed into a variety of shapes, can be used as a toy owing to the maximized tactile stimulation thereof, and provides effects such as psychological stability, stress relief and sensory development.

BEST MODE

Figure 1:
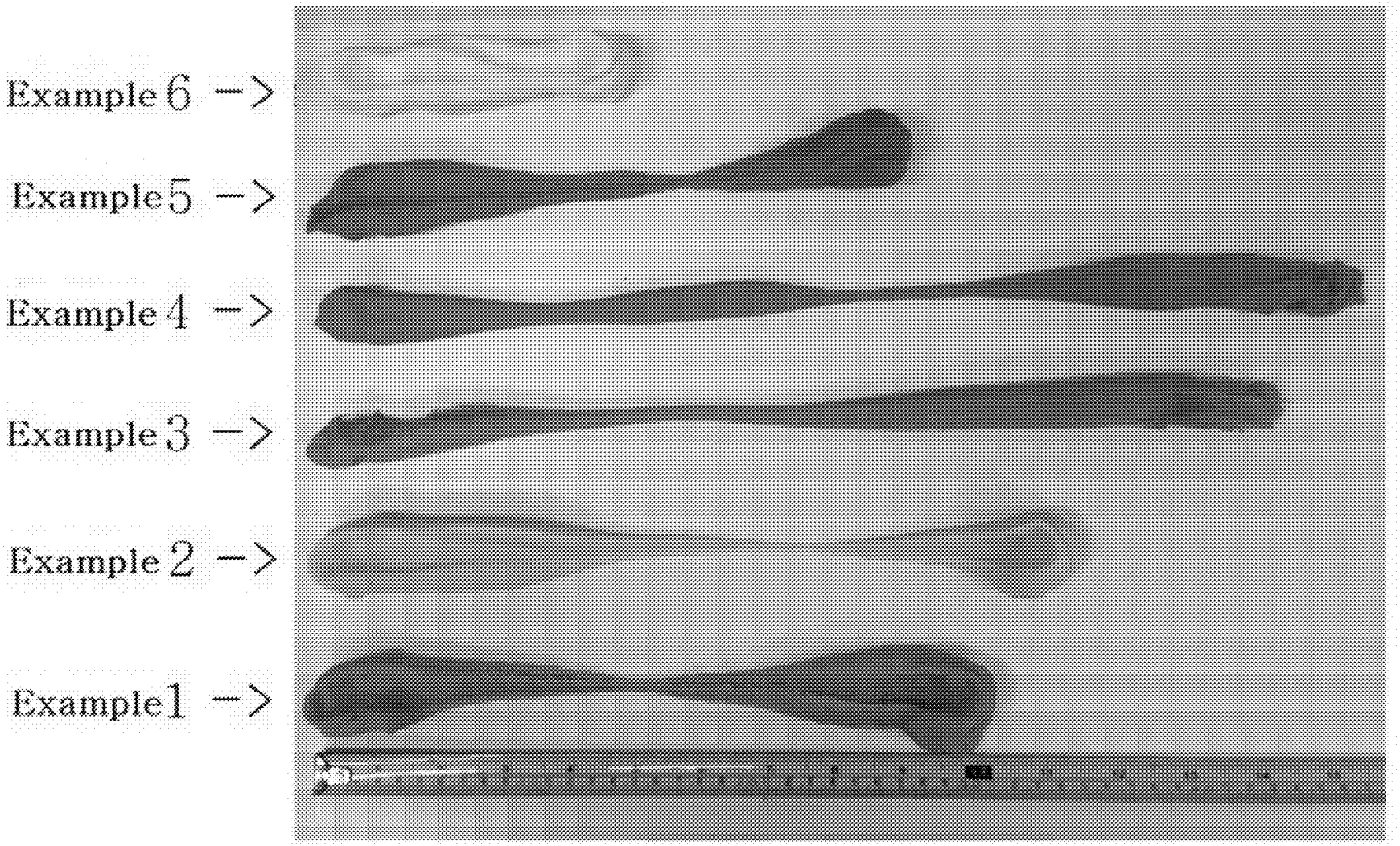
FIG. 1 shows the result of a test on the elasticity of soap compositions prepared in Examples 1 to 5 according to the present invention.

As a result of extensive research, the present inventors devised a composition and composition ratio enabling preparation of a soap with excellent elasticity, viscoelasticity and ductility which has a superior cleaning function, can be freely transformed and molded into a variety of shapes and thus has enhanced play value. That is, the present inventors have developed a soap composition having elasticity, viscoelasticity and ductility while containing neither borax nor a plastic material, and a method of preparing the same.

The soap composition having elasticity, viscoelasticity and ductility according to the present invention includes a biopolymer, a soap solution, starch and an auxiliary agent, and more specifically, the biopolymer is preferably present in an amount of 0.5 to 10% by weight based on the total weight of the soap composition. Purified water may also be added as needed.

The biopolymer, which is one of the ingredients of the soap composition according to present invention, serves as a support or base for providing elasticity, viscoelasticity and ductility. The biopolymer may include at least one of: a thickener such as mannan, glucomannan, a *Plantago psyllium* husk powder, gluten, guar gum, agar, alginic acid, locust bean gum, xanthan gum, carrageenan, dextran, diutan gum, glucosamine, gellan gum, gelatin, pectin, whey protein, hydroxyethyl cellulose, carboxymethylcellulose (CMC) or salep; a natural resin such as karaya gum, tragacanth gum, arabic gum, mastic gum, chicle, sorva, jelutong, or natural rubber (*Hevea brasiliensis*); and a mucopolysaccharide such as collagen, chitin, chitosan or hyaluronic acid.

The soap solution, which is one of the ingredients of the soap composition according to the present invention, serves as a detergent, as well as a hardener that can adjust the hardening rate and degree of hardening. At the same time, the soap solution acts as a stabilizer to maintain the structure. Specifically, the soap solution according to the present invention refers to a dissolved soda of fatty acid (soap), in which a fatty acid or vegetable oil is dissolved and is saponified with sodium hydroxide, potassium hydroxide or emulsified water and can be subsequently hardened into a solid spontaneously or with assistance. The soap inhibits microbial growth and has a longer shelf life than a conventional gel composition, in which microorganisms can easily grow. When the biopolymer of the present invention reacts with the soap solution to form a long chain, it becomes thick while retaining moisture therein. When the thick soap solution is stirred with a continuously applied strong force during hardening, the solution becomes dense and is cross-linked at a predetermined temperature and a given acidity to form a matrix structure. In other words, the biopolymer reacts with the soap solution to increase elasticity, viscosity and stability, and provide stability.

Starch, which is one of the ingredients of the soap composition according to the present invention, may be divided into starch from grains and starch from tubers and root plants. Starch from grains is structurally stable, is gelled at a relatively high temperature, is opaque, and may be wheat starch, corn starch, waxy corn starch, rice starch, mung bean starch or the like. Starch from tubers and root plants is rapidly gelatinized at lower temperatures and has a longer chain molecule than grain amylose. Starch from tubers and root plants includes potato starch, sweet potato starch, tapioca starch, kudzu starch, lotus root starch, Chinese yam (*Dioscorea batatas*) starch and the like. Starch may include at least one selected from the starches described above. Since the starch is gelatinized at a predetermined temperature, the soap solution is heated to the gelatinization temperature or higher while remaining within the temperature range of maximum viscosity when the starch is mixed with the soap solution. The gelatinization temperature and maximum viscosity temperature vary depending on the type of starch, and thus should be considered depending on the composition used.

The auxiliary agent, which is one of the ingredients of the soap composition according to the present invention, assists in the functions of cleaning, hardening and gelling of the composition containing the biopolymer and soap solution or to adjust the acidity or viscosity thereof, and includes at least one selected from a surfactant, a concentration regulator, an acidity regulator and a hardener, and one or more types thereof may be mixed appropriately according to the intended use.

The surfactant functions to improve, supplement or strengthen the cleaning power of the soap solution, and the function thereof can be controlled by changing the concentration and the surfactant increases the shelf life of the composition. In addition, there is an advantage in that the composition is not dried easily when controlling the water content using a liquid surfactant. However, when an excess liquid surfactant is used, the stickiness becomes too severe for use as a toy.

The surfactant may include at least one selected from an alkyl-sulfate-based surfactant, an alkyl-ether-sulfate-based surfactant, an amino-acid-derivative-based surfactant, a sulfosuccinate-based surfactant, an alkanolamide-based surfactant, an alkyl-betaine-based surfactant, an amphodiacetate-based surfactant, a natural surfactant, a polyglycerin fatty acid ester, a sorbitan fatty acid ester and a polyoxyethylene fatty acid ester.

The alkyl-sulfate-based surfactant may include at least one selected from ammonium lauryl sulfate and TEA-lauryl sulfate, and the alkyl-ether-sulfate-based surfactant having excellent skin moisturizing and antibacterial functions may include at least one selected from sodium laureth sulfate and ammonium laureth. In addition, the amino-acid-derivative-based surfactant, which is an anionic surfactant having excellent cleaning function and foaming stability, may include at least one selected from TEA-cocoyl glutamate, disodium lauroyl glutamate, sodium lauroyl glutamate, sodium cocoyl alaninate, sodium cocoyl glutamate and sodium cocoyl apple amino acid, and the sulfosuccinate-based surfactant, which is effective for preventing and alleviating skin troubles owing to the excellent cleaning ability thereof, may include at least one selected from disodium laureth sulfosuccinate and disodium lauryl sulfosuccinate. In addition, the alkanolamide-based surfactant may include at least one selected from lauramide DEA, cocamide MEA and cocamide DEA, the alkyl-betaine-based surfactant, which causes almost no skin irritation, has antibacterial and conditioning effects due to the rich foaming, and excellent viscosity formation capability and cationic properties, and may include at least one selected from lauramidopropyl betaine, cocamidopropyl betaine and babassuamidopropyl betaine. In addition, the amphodiacetate-based surfactant may include at least one selected from disodium coco amphodiacetate and disodium lauroamphodiacetate. In addition, the natural surfactant may include at least one selected from potassium olivate, potassium olivoyl PCA, potassium cocoate, sodium PEG-7 olive oil carboxylate, lauryl glucoside, lecithin and decyl glucoside. In addition, the polyglycerin fatty acid ester is a nonionic surfactant and may include at least one selected from lauric acid, myristic acid, stearic acid, oleic acid and behenic acid. The sorbitan fatty acid ester is a highly safe non-ionic surfactant and may include at least one selected from sorbitan monolaurate (Span 20), sorbitan palmitate (Span 40), sorbitan stearate (Span 60), sorbitan oleate (Span 80), sorbitan isostearate, sorbitan trioleate and sorbitan olivate. The polyoxyethylene fatty acid ester may include at least one selected from polyoxyethylene sorbitan monolaurate, polyoxyethylene sorbitan monostearate and polyoxyethylene sorbitan monooleate. It is preferable to use a combination of two or three kinds of at least one surfactant selected in consideration of moisturizing, cleaning and antibacterial activity and the like.

The concentration regulator is used to control the water content, softness, concentration or the like of the toy, in particular, distilled water, glycerin, vegetable oil or the like, and may help prevent the composition from sticking to the hands, and glycerin, sugar or the like increases the shelf life of the composition.

The concentration regulator may include at least one selected from distilled water, glycerin, vegetable oil, sucrose, oligosaccharides, maltose and honey. At this time, the vegetable oil may include at least one selected from olive oil, coconut oil, palm oil, camellia oil, avocado oil, sunflower seed oil, canola oil, grape seed oil, apricot seed oil, cottonseed oil, kenaf oil, bay leaf oil, rice bran oil, hazelnut oil, evening primrose oil, green tea seed oil, Jojoba oil, almond oil, moringa seed oil, citron seed oil, grapefruit seed oil, Sacha Inchi oil, argan oil, neem oil, soybean oil, flaxseed oil, macadamia nut oil, borage oil, cherry seed oil, broccoli seed oil, kukui nut oil, rose hip oil, coffee seed oil, meadowfoam seed oil, hemp seed oil, pumpkin seed oil, blackcurrant oil, oatmeal oil, castor oil, lotus seed oil, corn oil, peanut oil, safflower oil, pine nut oil, cashew oil, pistachio oil, pecan oil, walnut oil, mongongo nut oil, marula seed oil, mustard oil, perilla oil, sesame oil and watermelon seed oil.

The acidity regulator may include at least one selected from sodium hydrogen carbonate, sodium chloride, citric acid, ascorbic acid and acetic acid.

The hardener may include at least one selected from wax, hardened oil, lanolin wax, candelilla wax, carnauba wax, calcium chloride, olive emulsified wax, soy wax, potassium chloride and calcium hydroxide, wherein the hardened oil may include at least one selected from shea butter, coconut butter, palm butter, avocado butter, cocoa butter, coffee butter, calendula butter, camellia butter, hemp seed butter, Jojoba butter, aloe butter, olive butter and cocoa butter.

Although a soap composition having elasticity, viscoelasticity and ductility can be prepared using the above ingredients, the method of preparing a soap according to the present invention, which is more suitable for use as a toy includes: mixing and stirring 10 to 30% by weight of a soap solution, 0.5 to 10% by weight of a biopolymer, 1 to 10% by weight of a nonionic surfactant, 3 to 10% by weight of glycerin, 5 to 15% by weight of a vegetable oil, 10 to 20% of sucrose, 1 to 10% by weight of distilled water and 30 to 50% by weight of starch (a); and cooling the resulting mixture to 0 to 35° C. and aging the same (b) after the step (a), wherein the biopolymer includes at least one of: at least one thickener selected from mannan, glucomannan, a *Plantago psyllium* husk powder, gluten, guar gum, agar, alginic acid, locust bean gum, xanthan gum, carrageenan, dextran, diutan gum, glucosamine, gellan gum, gelatin, pectin, whey protein, hydroxyethyl cellulose, carboxymethylcellulose (CMC) and salep; at least one natural resin selected from karaya gum, tragacanth gum, arabic gum, mastic gum, chicle, sorva, jelutong and natural rubber (*Hevea brasiliensis*); and at least one mucopolysaccharide selected from collagen, chitin, chitosan and hyaluronic acid. Hereinafter, each step will be described in more detail.

<Step (a): Preparation of Soap Mixture Having Elasticity, Viscoelasticity and Ductility>

In step (a), 10 to 30% by weight of a soap solution, 0.5 to 10% by weight of a biopolymer, 1 to 10% by weight of a nonionic surfactant, 3 to 10% by weight of glycerin, 5 to 15% by weight of a vegetable oil, 10 to 20% of sucrose, 1 to 10% by weight of distilled water and to 50% by weight of starch were mixed and stirred. Through this step, a soap mixture having elasticity, viscoelasticity and ductility can be prepared.

The soap solution may be, for example, a fatty acid soda (soap solution) prepared by dissolving fatty acid or vegetable oil and saponifying the same with sodium hydroxide, potassium hydroxide or emulsified water, or may be prepared by melting the saponified solid soap by heating.

Preferably, the biopolymer may be introduced with at least one thickener selected from mannan, glucomannan, a *Plantago psyllium* husk powder, agar, carrageenan, gellan gum and gelatin. This case is very effective in forming matrix structures. When the biopolymer is further introduced, in addition to the thickener, with at least one natural resin selected from karaya gum, tragacanth gum, arabic gum, mastic gum, chicle, sorva, jelutong, and natural rubber (*Hevea brasiliensis*), the biopolymer exhibits increased viscosity and creates a harder matrix structure, which can trap more moisture therein and thereby prevent the composition from drying out.

In order for the soap composition to have excellent elasticity, the soap composition should be thoroughly stirred until the soap composition is cooled. When strong pressure and air are introduced during the stirring process, the soap composition becomes soft and the biopolymer matrix is activated, thus enhancing the elasticity and viscosity thereof.

<Step (b): Cooling and Aging>

In this step, the soap mixture is cooled to 0 to 35° C. and aged after step (a). That is, this step involves cooling and aging the soap mixture prepared in step (a), thus stabilizing the matrix structure formed in the soap mixture and stably settling water therein.

The present invention has the greatest advantage of having excellent stretchability and elasticity compared to a conventional soap clay (Korean Patent No. 10-1745855), other soap composition having elasticity (Korean Patent Laid-open No. 10-2004-53807), a hydrogel soap (Korean Patent Laid-open No. 10-2009-10344), and a hydrogel soap (Korean Patent No. 10-1305349). In addition, the present invention exhibits greatly improved viscosity and ductility. In particular, unlike other soap compositions in which, once molded, the shape cannot be easily changed, the composition according to the present invention can be changed into a variety of shapes and kneaded while changing the size by hand, thus maximizing sensory stimulation. Here, "elasticity" refers to a property of the material that increases or decreases in size, "viscoelasticity" refers to a property of the material including both viscosity, that is, stickiness, and elasticity, in which an object deformed by an external force tends to return to its original state when the force is removed, and "ductility" refers to mushiness or softness.

[Mode for Invention]

Hereinafter, the present invention will be described in more detail with reference to the following Examples or Experimental Examples. However, the scope of the present invention is not limited to these Examples or Experimental Examples, and also includes modifications equivalent thereto.

Examples 1 to 5: Preparation of Soap Composition of Present Invention 15.5 g of a solid soap was injected into a container, 2.5 g of decyl glucoside, as a nonionic surfactant, 4.6 g of glycerin, 8.3 g of vegetable oil (containing camellia oil, sunflower oil, coconut oil and canola oil at a ratio of 1.5:1:1:7.3) and 14.7 g of sucrose were injected into the container, and the resulting mixture was heated to 80° C., followed by stirring and melting, to prepare a soap mixture.

The melted soap mixture was mixed with 10 g of glucomannan as a biopolymer, 36.2 g of starch (containing wheat flour, tapioca starch and corn starch in a ratio of 1:2:2.3), and 8.2 g of purified water. Then, the mixture was stirred while slowly lowering the temperature from 70 to 80° C. to prepare a soap composition.

Next, 0.5 g of a colorant was added to 100 g of the elastic soap composition prepared above, and the soap composition containing the colorant was stirred and allowed to cool and age at a temperature of 25° C.

Meanwhile, the elastic soap compositions of Examples 2 to 6, having the compositions shown in Table 1, were prepared in the same manner as in Example 1, and performance depending on the added biopolymer was compared.

TABLE 1

| | Example 6 | Example 5 | Example 4 | Example 3 | Example 2 | Example 1 |
|---|---|---|---|---|---|---|
| Purified water | 8.2 | 8.2 | 8.2 | 8.2 | 8.2 | 8.2 |
| Soap solution | 15.5 | 15.5 | 15.5 | 15.5 | 15.5 | 15.5 |
| Surfactant | 2.5 | 2.5 | 2.5 | 2.5 | 2.5 | 2.5 |
| Glycerin | 4.6 | 4.6 | 4.6 | 4.6 | 4.6 | 4.6 |
| Vegetable oil | 8.3 | 8.3 | 8.3 | 8.3 | 8.3 | 8.3 |
| Sucrose | 14.7 | 14.7 | 14.7 | 14.7 | 14.7 | 14.7 |
| Biopolymer | 0 | 0.5 | 2.5 | 5 | 7.5 | 10 |
| Starch | 46.2 | 45.7 | 43.7 | 41.2 | 39.7 | 36.2 |
| Total amount | 100 parts by weight | | | | | |
| Colorant | 0 | 0.5 parts by weight | 0.5 parts by weight | 0.5 parts by weight | 0.5 parts by weight | 0.5 parts by weight |

Experimental Example 1: Elasticity Test of Soap Prepared in Example Above

The elastic soap compositions prepared in Examples 1 to 6 were stretched by hand until the elastic soap compositions did not break, and the elasticity thereof was visually determined (Table 2, FIG. 1).

TABLE 2

| | Example 6 | Example 5 | Example 4 | Example 3 | Example 2 | Example 1 |
|---|---|---|---|---|---|---|
| Elasticity | 0.5 | 2.5 | 4.5 | 4 | 3.5 | 3 |
| Color | White | Purple | Blue | Red | Yellow | Green |

Elasticity degree is designated from 0 to 5. As elasticity degree reaches 5, elasticity increases.

The experimental results of Table 2 and FIG. 1 showed that Examples 1 to 5, to which the biopolymer (glucomannan) was added, exhibited excellent elasticity and that Example 6, containing only starch, also exhibited very weak elasticity, but exhibited a significant difference from Examples 1 to 5.

Meanwhile, as the amount of the biopolymer that was added increased, the viscosity became too strong, causing an excessive amount of composition to be stuck to hands or emitting a strong smell. In addition, Example 1, to which the highest amount of biopolymer was added, also exhibited weaker elasticity than Examples 4 and 3, to which relatively small amounts of biopolymer were added. This means that the molecular chain is associated with water content. Example 1, to which distilled water or glycerin was further added, exhibited improved elasticity. In conclusion, it can be seen that addition of an appropriate amount of biopolymer is required, and that, in the present invention, the concentrations of biopolymer added in Examples 1 to 5, that is, 0.5 to 10.0 wt %, were determined to be suitable.

Figure 2:
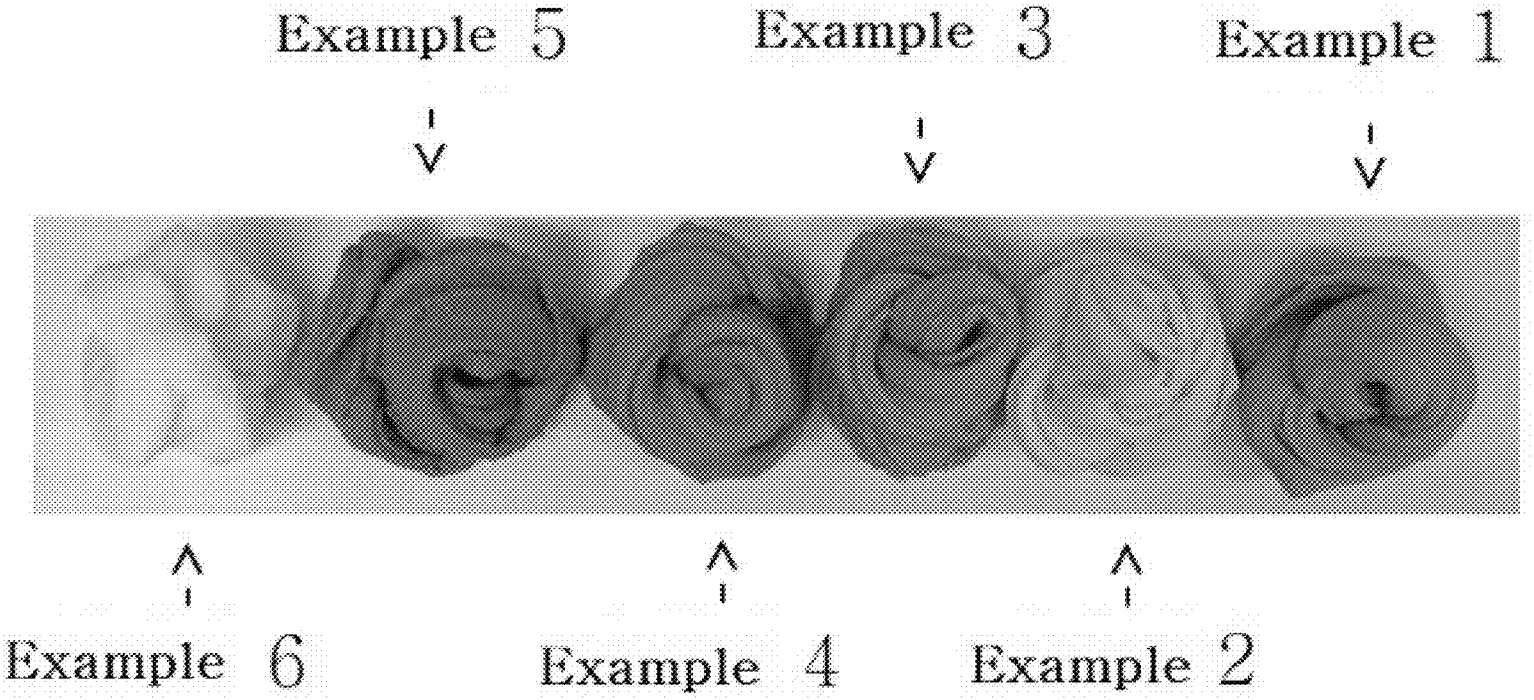
FIG. 2 shows the result of molding round articles by stretching and then rolling the soap compositions prepared in Examples 1 to 5, wherein the elasticity increases, whereby rolling to a smaller thickness is possible.

Meanwhile, FIG. 2 shows rolling forms of the stretched soap compositions according to the present invention shown in FIG. 1. This indicates that, as the elasticity increases, rolling to a smaller thickness is possible.

The invention claimed is:

1. A shaped soap composition comprising:

0.5 to 10% by weight of a biopolymer;

10 to 30% by weight of a soap solution;

30 to 50% by weight of a starch;

1 to 10% by weight of a nonionic surfactant;

3 to 10% by weight of glycerin;

5 to 15% by weight of a vegetable oil;

10 to 20% of sucrose; and 1 to 10% by weight of distilled water, wherein the biopolymer comprises glucomannan and at least one of:

at least one thickener selected from mannan, a *Plantago psyllium* husk powder, gluten, guar gum, agar, alginic acid, locust bean gum, xanthan gum, carrageenan, dextran, diutan gum, glucosamine, gellan gum, gelatin, pectin, whey protein, hydroxyethyl cellulose, carboxymethylcellulose (CMC) and salep;

at least one natural resin selected from karaya gum, tragacanth gum, arable gum, mastic gum, chicle, sorva, jelutong and natural rubber (*Hevea brasiliensis*); and at least one mucopolysaccharide selected from collagen, chitin, chitosan and hyaluronic acid.

2. The soap composition according to claim 1, wherein the biopolymer is added in an amount of 0.5 to 10% by weight with respect to the total weight of the soap composition.

3. A method of preparing a shaped soap comprising:

mixing and stirring 10 to 30% by weight of a soap solution, 0.5 to 10% by weight of a biopolymer, 1 to 10% by weight of a nonionic surfactant, 3 to 10% by weight of glycerin, 5 to 15% by weight of a vegetable oil, 10 to 20% of sucrose, 1 to 10% by weight of distilled water and 30 to 50% by weight of starch (a); and cooling the resulting mixture to 0 to 35° C., and aging the same (b) after the step (a), wherein the biopolymer comprises glucomannan, and at least one of:

at least one thickener selected from mannan, a *Plantago psyllium* husk powder, gluten, guar gum, agar, alginic acid, locust bean gum, xanthan gum, carrageenan, dextran, diutan gum, glucosamine, gellan gum, gelatin, pectin, whey protein, hydroxyethyl cellulose, carboxymethylcellulose (CMC) and salep;

at least one natural resin selected from karaya gum, tragacanth gum, arable gum, mastic gum, chicle, sorva, jelutong, and natural rubber (*Hevea brasiliensis*); and at least one mucopolysaccharide selected from collagen, chitin, chitosan and hyaluronic acid.

4. The method according to claim 3, wherein the soap solution is a fatty acid soda prepared by dissolving fatty acid or vegetable oil and saponifying the same with sodium hydroxide, potassium hydroxide or emulsified water, or is prepared by melting the saponified solid soap by heating.

* * * * *